US006131763A

United States Patent [19]

Stanish et al.

[11] Patent Number: 6,131,763

[45] Date of Patent: Oct. 17, 2000

[54] BEVERAGE CONTAINER AND DISPENSER APPARATUS

[76] Inventors: Walt Stanish, 1617 Mt. Silliman Way, Antioch, Calif. 64509; Scott Steinheiser, 540 Mt. Davidson Ct., Clayton, Calif. 94517

[21] Appl. No.: 09/356,609

[22] Filed: Jul. 19, 1999

[51] Int. Cl.[7] ..... B65D 47/06

[52] U.S. Cl. ..... 220/706; 220/709; 220/710; 215/388

[58] Field of Search ..... 220/268, 269, 220/710, 706, 709; 215/388

[56] References Cited

U.S. PATENT DOCUMENTS

| | | | |
|---|---|---|---|
| 3,759,206 | 9/1973 | Dalli et al. | 220/268 |
| 4,228,913 | 10/1980 | Mack et al. | 220/710 |
| 4,356,927 | 11/1982 | Cooper et al. | 220/710 |
| 4,690,294 | 9/1987 | Jones | 220/710 |
| 4,930,652 | 6/1990 | Murphy et al. . | |
| 5,172,827 | 12/1992 | Chang et al. . | |
| 5,397,014 | 3/1995 | Aydt | 220/269 |
| 5,431,297 | 7/1995 | Rosello | 220/710 |
| 5,522,524 | 6/1996 | Nmngani . | |
| 5,547,103 | 8/1996 | Murphy et al. . | |
| 5,695,085 | 12/1997 | Hadener | 220/269 |
| 5,788,106 | 8/1998 | Hotinski . | |
| 5,819,979 | 10/1998 | Murphy et al. . | |
| 5,823,422 | 10/1998 | Collier et al. . | |
| 6,036,048 | 3/2000 | Fischman | 220/706 |

*Primary Examiner*—Joseph M. Moy
*Attorney, Agent, or Firm*—Thomas R. Lampe

[57] ABSTRACT

A beverage can has a tab member rotatably and pivotally mounted thereon. The tab member can be used to form two separate openings in the can top. Under one of the openings is a drinking straw which will be presented to the user after the opening with which it is associated is formed in the can top.

4 Claims, 2 Drawing Sheets

BEVERAGE CONTAINER AND DISPENSER APPARATUS

TECHNICAL FIELD

This invention relates to a container for dispensing beverages. The apparatus incorporates a self-contained drinking straw which becomes accessible to the user when an opening is made in the container.

BACKGROUND OF THE INVENTION

It is well known to form an opening in a beverage can by means of a manually manipulatable tab member. The tab member is pulled and pivoted to bear against a portion of the top of the can defined by a line or lines of weakness. Such arrangements are commonly known as "pop top" cans.

A number of devices have been devised in the past in which drinking straws are stored within the interior of a can, the drinking straw being exposed for use after the can has been opened by a tab member.

The following United States Patents are believed to be generally representative of the state of the art in this field, all of the patents disclosing structure for making a drink straw available to the user which is wholly or partially stored within the confines of a container and exposed for use after the container has been opened: U.S. Pat. No. 5,172,827, issued Dec. 22, 1992, U.S. Pat. No. 5,823,422, issued Oct. 20, 1998, U.S. Pat. No. 5,522,524, issued Jun. 4, 1996, U.S. Pat. No. 5,788,106, issued Aug. 4, 1998, U.S. Pat. No. 5,547,103, issued Aug. 20, 1996, U.S. Pat. No. 5,819,979, issued Oct. 13, 1998, and U.S. Pat. No. 4,930,652, issued Jun. 5, 1990.

U.S. Pat. No. 5,172,827 is of particular interest since it discloses a rotatable tab member which can be employed to open a single hole comprised of two hole segments. Both segments of the hole must be opened before a drinking straw can be extracted from the container. Extraction of the straw is accomplished by disposing the upper end of a flexible-like straw within a collar which is attached to a panel or portion of the can top covering one of the hole segments. The straw is exposed when the panel is bent upwardly by the tab member.

None of the references cited above suggest or teach the arrangement disclosed and claimed herein which is characterized by its relative simplicity, ease of use, reliability and low cost as compared to known prior art devices.

DISCLOSURE OF INVENTION

The apparatus of the present invention is for dispensing beverages. The apparatus includes a container body including a container top and defining an interior for holding a beverage. The container top has a first line of weakness terminating at a first bend line and a second line of weakness terminating at a second bend line.

The first line of weakness and the first bend line form a first top portion in the container top. The second line of weakness and the second bend line form a second top portion in the container top spaced from the first top portion.

The first and second bend lines are spaced from one another with an area of the container top being disposed therebetween.

A pivot member is attached to the container top within said area.

A tab member is rotatably and pivotally mounted on the pivot member and has a container top engagement end and a pull end located on opposed sides of the pivot member.

The tab member is manually selectively rotatable about the pivot member to either place the container top engagement end thereof over the first top portion whereby pivotal movement of the tab member about the pivot member will cause the first top portion to bend downwardly relative to the first bend line to form a first opening in the container top or place the container top engagement end thereof over the second top portion whereby pivotal movement of the tab member about the pivot member will cause the second top portion to bend downwardly relative to the second bend line to form a second opening in the container top.

A drinking straw and a straw guide are disposed in the interior of the container body, the drinking straw having upper and lower straw ends and the straw guide maintaining the straw oriented with the upper straw end below the first top portion whereby the upper straw end will be in a position enabling the upper straw end to project through the first opening after the first top portion has been bent downwardly relative to the first bend line by the tab member.

Other features, advantages, and objects of the present invention will become apparent with reference to the following description and accompanying drawings.

MODES FOR CARRYING OUT THE INVENTION

Figure 1:
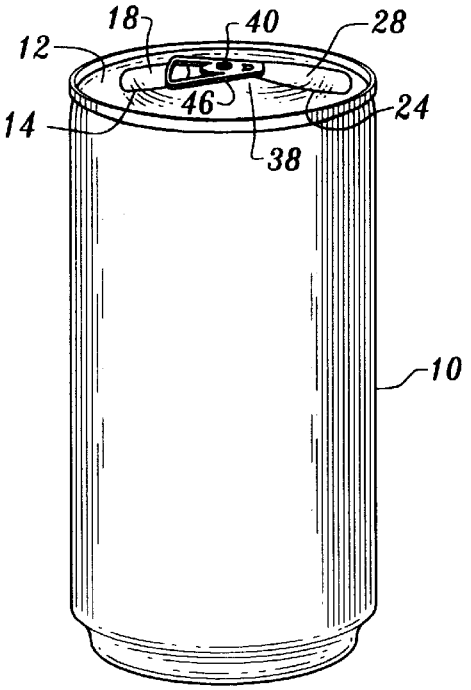
FIG. 1 is a perspective view of a container in the form of a can incorporating the teachings of the present invention.

Referring now to FIGS. 1–7, a beverage can 10 having a container top 12 defines an interior for holding a beverage.

A line of weakness 14 terminating at a straight bend line 16 forms therewith a top portion 18 within the confines of the container top.

A line of weakness 24 terminating at a bend line 26 forms therewith another top portion 28 in the can top.

The top portions 18, 28 are spaced from one another with an area 38 of the container top being disposed therebetween.

The bend lines 16, 26 are straight and parallel to one another and define the outer extent of area 38.

A pivot pin or member 40 is attached to the container top in area 38.

A tab member 46 is rotatably and pivotally mounted on the pivot pin or member 40. As is conventional, tab member 46 has a container top engagement end (the narrow end illustrated in the drawings) and a pull end (the wide end illustrated in the drawings) located on opposed sides of the pivot member 40.

Figure 2:
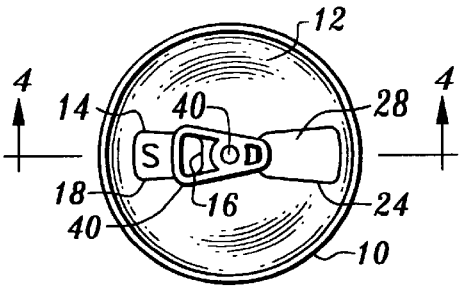
FIG. 2 is a top plan view of the can illustrating a tab member associated therewith in one position.
Figure 3:
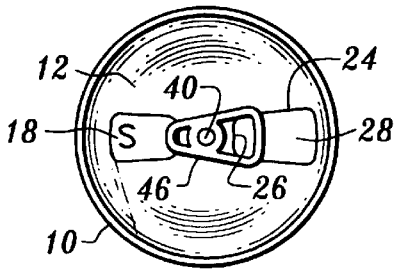
FIG. 3 is a view similar to FIG. 2 but illustrating the tab member in a second position.
Figure 4:
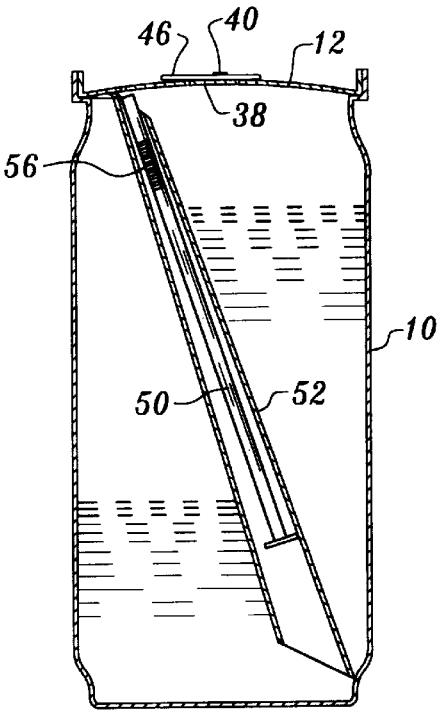
FIG. 4 is a cross-sectional, elevational view taken along the line 4—4 of FIG. 2 and illustrating the can in a closed condition.

The tab member may be selectively rotatably moved about the pivot member to either place the container top engagement end thereof over top portion 18 (shown in FIG. 3, for example) or over top portion 28 (as shown in FIG. 2, for example).

Figure 5:
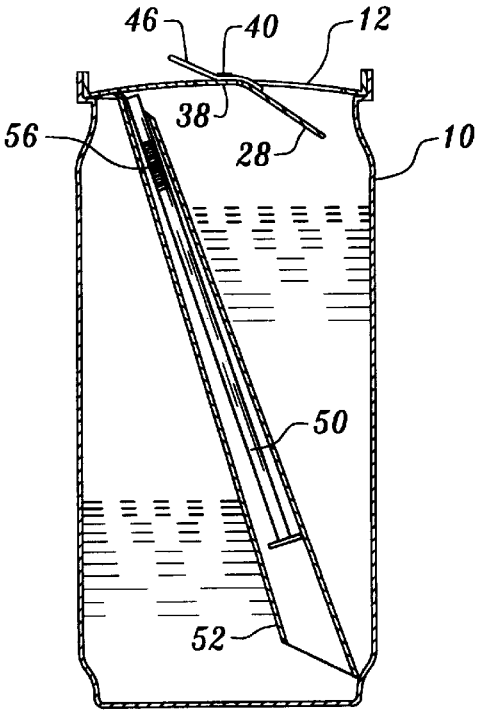
FIG. 5 is a view similar to FIG. 4 but illustrating the tab member being employed to open one of two possible openings in the can.
Figure 6:
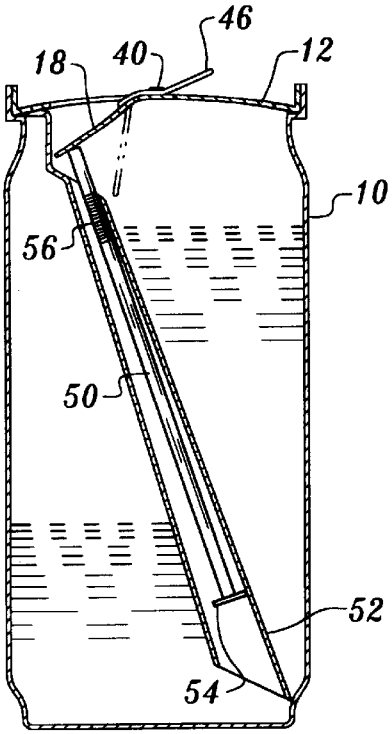
FIG. 6 is a view similar to FIG. 4 but illustrating the tab member being employed to open the other of the two openings in the can top.
Figure 7:
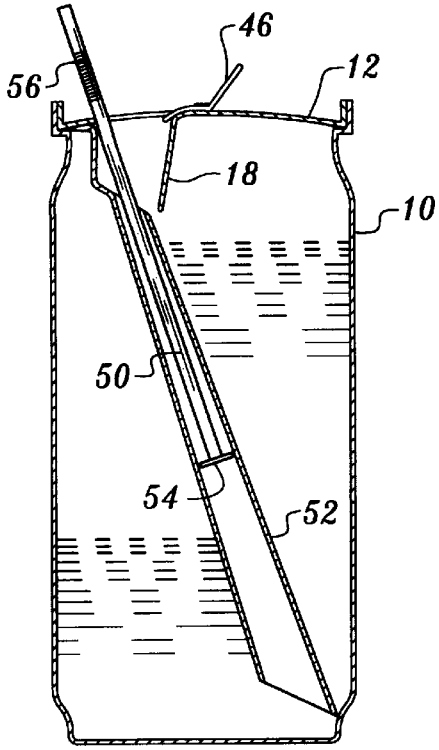
FIG. 7 is a view similar to FIG. 6 but illustrating a drinking straw extending through the opening formed during the procedure shown in FIG. 6.

Pivotal movement of the tab member will cause the top portion engaged by the tab member top engagement end to break from the can at the line of weakness forming same and bend downwardly about its associated bend line. FIG. 5 shows top portion 28 deflected downwardly to form an opening in the can top and FIGS. 6 and 7 show top portion 18 deflected downwardly relative to its associated bend line to form a different opening. One or both openings may be formed in the can top. If one chooses to form both openings, they are separated by area 38 of the can top.

Located within the interior of the container body is a drinking straw 50 having an upper straw end and a lower straw end. Drinking straw 50 is slidably disposed in a tube-like straw guide 52 disposed within the interior of the container. Guide 52 is open at both the top and bottom thereof. The upper end of the guide is positioned below top portion 18. After the tab member 46 has been used to fully deflect downwardly the top portion 18 (as shown in FIG. 7), the drinking straw 50 will be free to move upwardly in the guide 52 so that the top end of the straw projects through the opening formed in the can at that location. This can be accomplished automatically by ensuring that the material forming the straw is less dense than the beverage. Also, of course, in the case of carbonated beverages, the carbonation itself can assist in moving the straw in an upward direction. Suitable indicia such as the letter "S" may be on the top surface of top portion 18 to indicate that that top portion is the one to be deflected to expose the straw.

The top opening of guide 52 is smaller in size than a projection in the form of a flange 54 extending outwardly from the bottom end of the straw 50. This will prevent the straw from completely exiting the interior of the can. The straw has an accordian pleated section 56 which is normally compressed.

After the upper end of the straw is initially exposed, the user pulls the straw to lengthen the straw so that the top end of the straw will always be located above the can top, even when the beverage is nearly depleted and the straw bottom is at the can bottom.

In this embodiment of the invention the top of the guide 52 is spaced from the can top a distance greater than the length of top portion 18. This feature, as represented by FIGS. 6 and 7, enables the top portion 18 to clear the guide during the opening procedure. As the top portion 18 moves to its fully deflected state it will bear against the straw 50 forcing the down in guide 52 until the top portion 18 clears the straw.

Figure 8:
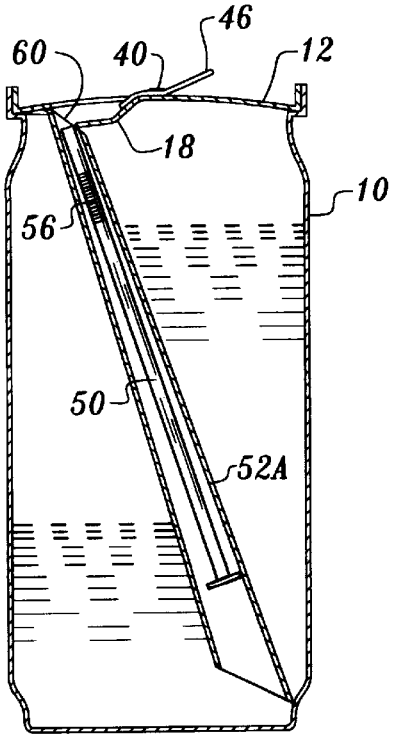
FIG. 8 is a view similar to FIG. 6 but illustrating an alternative embodiment of the invention and the tab member initiating formation of an opening over a drinking straw in the container.
Figure 9:
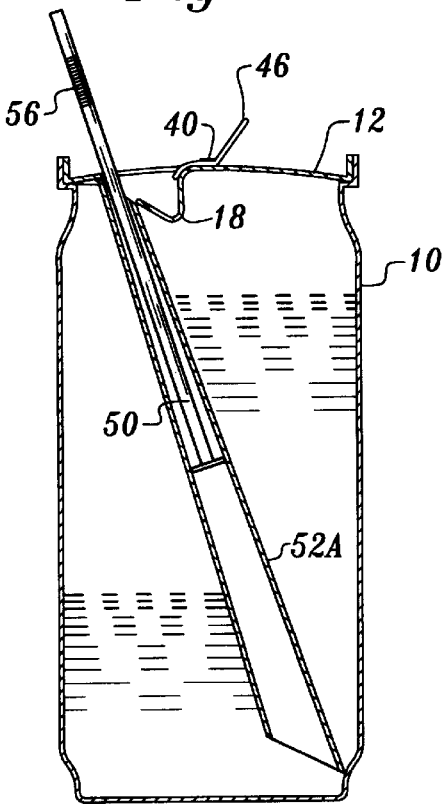
FIG. 9 illustrates the embodiment of FIG. 8 after the opening has been completely formed and the top end of a straw projects therefrom.

FIGS. 8 and 9 illustrate a somewhat different embodiment of the invention wherein the guide 52A extends to the top of the can. The upper guide end is slanted where designated by reference numeral 60. As top portion 18 is bent downwardly by tab member 46 the distal or free end thereof will bear against the slanted end 60 of the straw guide. This will cause the opening portion 18 to bend or fold as shown in FIG. 9 so that the top portion 18 clears the top opening of the guide 52A.

It will thus be seen from the above description that a person using a container incorporating the present invention will be able to either use a straw or not use a straw, as desired, depending upon which of the openings is formed. Of course, as indicated above a user can open both openings if desired.

What is claimed is:

1. Apparatus for dispensing beverages, said apparatus comprising:

a container body including a container top and defining an interior for holding a beverage, said container top having a first line of weakness terminating at a first bend line and a second line of weakness terminating at a second bend line, said first line of weakness and said first bend line forming a first top portion in said container top and said second line of weakness and said second bend line forming a second top portion in said container top spaced from said first top portion, and said first and second bend lines being spaced from one another with an area of said container top disposed therebetween and between said top portions;

a pivot member attached to said container top within said area;

a tab member rotatably and pivotally mounted on said pivot member and having a container top engagement end and a pull end located on opposed sides of said pivot member, said tab member being manually selectively rotatable about said pivot member to either place the container top engagement end thereof over said first top portion whereby pivotal movement of said tab member about said pivot member will cause said first top portion to bend downwardly relative to said first bend line to form a first opening in said container top or place the container top engagement end thereof over said second top portion whereby pivotal movement of said tab member about said pivot member will cause said second top portion to bend downwardly relative to said second bend line to form a second opening in said container top;

a drinking straw;

a straw guide in the interior of said container body connected to and extending downwardly from said container top, said drinking straw having upper and lower straw ends and said straw guide maintaining the straw oriented with the upper straw end below said first top portion whereby said upper straw end will be in a position enabling said upper straw end to protect through said first opening after said first top portion has been bent downwardly relative to said first bend line by said tab member to form said first opening, said straw guide surrounding said drinking straw and including an upper open guide end positioned below said first top portion; and a projection attached to said drinking straw at the lower straw end engageable with said straw guide during upward movement of said drinking straw within said straw guide to prevent the lower straw end from exiting said straw guide through said upper open guide end, said upper guide end and said container top defining a space therebetween for accommodating said first top portion when said first top portion is being bent downwardly relative to said first bend line by said tab member to form said first opening.

2. The apparatus according to claim 1 wherein said upper open guide end is spaced from said first top portion a sufficient distance to avoid contact between said straw guide and said first top portion when said first top portion is being bent downwardly relative to said first bend line by said tab member to form said first opening.

3. The apparatus according to claim 1 wherein said upper open guide end is slanted and cooperable with said first top portion to form a bend in said first top portion when said first top portion is being bent downwardly relative to said first bend line by said tab member to form said first opening.

4. The apparatus according to claim 1 wherein indicia is located on one of said top portions to indicate whether a drinking straw is disposed thereunder.

* * * * *